US008436517B2

(12) United States Patent
Oki

(10) Patent No.: US 8,436,517 B2
(45) Date of Patent: May 7, 2013

(54) LIGHT BULB

(75) Inventor: Isamu Oki, Tainan (TW)

(73) Assignee: Yandent Co., Ltd., Taipei (TW)

( * ) Notice: Subject to any disclaimer, the term of this patent is extended or adjusted under 35 U.S.C. 154(b) by 305 days.

(21) Appl. No.: 12/905,783

(22) Filed: Oct. 15, 2010

(65) Prior Publication Data

US 2011/0273072 A1 Nov. 10, 2011

(30) Foreign Application Priority Data

May 10, 2010 (TW) ..... 99114790 A
Jun. 1, 2010 (TW) ..... 99117571 A

(51) Int. Cl.
*H01J 61/52* (2006.01)

(52) U.S. Cl.
USPC ..... 313/46; 362/373

(58) Field of Classification Search ..... 362/373, 362/294, 800, 650, 235, 227, 231, 293, 454; 313/46, 484–487, 489, 498, 512, 467–468, 313/499, 501–503; 257/98–100, 79, 80; 345/44, 46; 438/22, 26, 458
See application file for complete search history.

(56) References Cited

U.S. PATENT DOCUMENTS

2011/0075431 A1* 3/2011 Wu ..... 362/373

* cited by examiner

*Primary Examiner* — Anh Mai
*Assistant Examiner* — Elmito Breval
(74) *Attorney, Agent, or Firm* — Stroock & Stroock & Lavan LLP

(57) ABSTRACT

A light bulb includes an enclosure, a heat-dissipating unit, and a lamp unit. The enclosure extends along an axis, and defines an inner space therein. The heat-dissipating unit includes a hollow first heat-dissipating element disposed in the inner space, a second heat-dissipating element surrounded by the first heat-dissipating element and extending along the axial direction, and an end heat-dissipating element mounted to the second heat-dissipating element at a distal end thereof. The lamp unit includes a first circuit board disposed at a periphery of the first heat-dissipating element, a second circuit board mounted on the end heat-dissipating element, and a plurality of light-emitting elements mounted on the first and second circuit boards for emitting light beams.

7 Claims, 9 Drawing Sheets

LIGHT BULB

CROSS-REFERENCE TO RELATED APPLICATIONS

This application claims priority of Taiwanese application No. 099114790, filed on May 10, 2010 and Taiwanese application No, 099117571, filed on Jun. 1, 2010.

BACKGROUND OF THE INVENTION

1. Field of the Invention

The invention relates to a light bulb, more particularly to a light bulb capable of dissipating heat that is generated during use.

2. Description of the Related Art

Referring to FIGS. 1 and 2, Taiwanese Patent No. M377525 discloses a conventional light bulb 1 comprising a base circuit board 11, a plurality of extending circuit boards 12 electrically connected to the base circuit board 11, a plurality of light-emitting diodes (LEDs) 13 mounted on the extending circuit boards 12, an enclosure 14 receiving the base circuit board 11, the extending circuit boards 12, and the LEDs 13 therein, and an externally threaded lamp seat 15 coupled to the enclosure 14, electrically connected to the base circuit board 11, and disposed for engaging threadedly a lamp socket (not shown).

Though the above-mentioned light bulb 1 can provide illumination, heat generated by components of the light bulb 1 cannot be dissipated effectively and may damage the LEDs 13. Therefore, the service life of the conventional light bulb 1 is relatively short.

SUMMARY OF THE INVENTION

Therefore, the object of the present invention is to provide a light bulb that can dissipate heat generated during use and that is durable.

According to the present invention, there is provided an light bulb including an enclosure, a heat-dissipating unit, and a lamp unit. The enclosure extends along an axis, defines an inner space therein, and has an open end registered with the axis. The heat-dissipating unit includes a hollow first heat-dissipating element that is disposed in the inner space of the enclosure, a second heat-dissipating element that is surrounded by the first heat-dissipating element, that extends along the axial direction, and that cooperates with the first heat-dissipating element to define a heat-dissipating compartment therebetween, and an end heat-dissipating element that is mounted to the second heat-dissipating element at a distal end thereof distal from the open end of the enclosure. The lamp unit includes a first circuit board disposed at a periphery of the first heat-dissipating element, a second circuit board mounted on the end heat-dissipating element at one side opposite to the open end along the axis, and a plurality of light-emitting elements mounted on the first and second circuit boards for emitting light beams.

BRIEF DESCRIPTION OF THE DRAWINGS

Other features and advantages of the present invention will become apparent in the following detailed description of the preferred embodiments with reference to the accompanying drawings, of which.

DETAILED DESCRIPTION OF THE PREFERRED EMBODIMENTS

Figure 1:
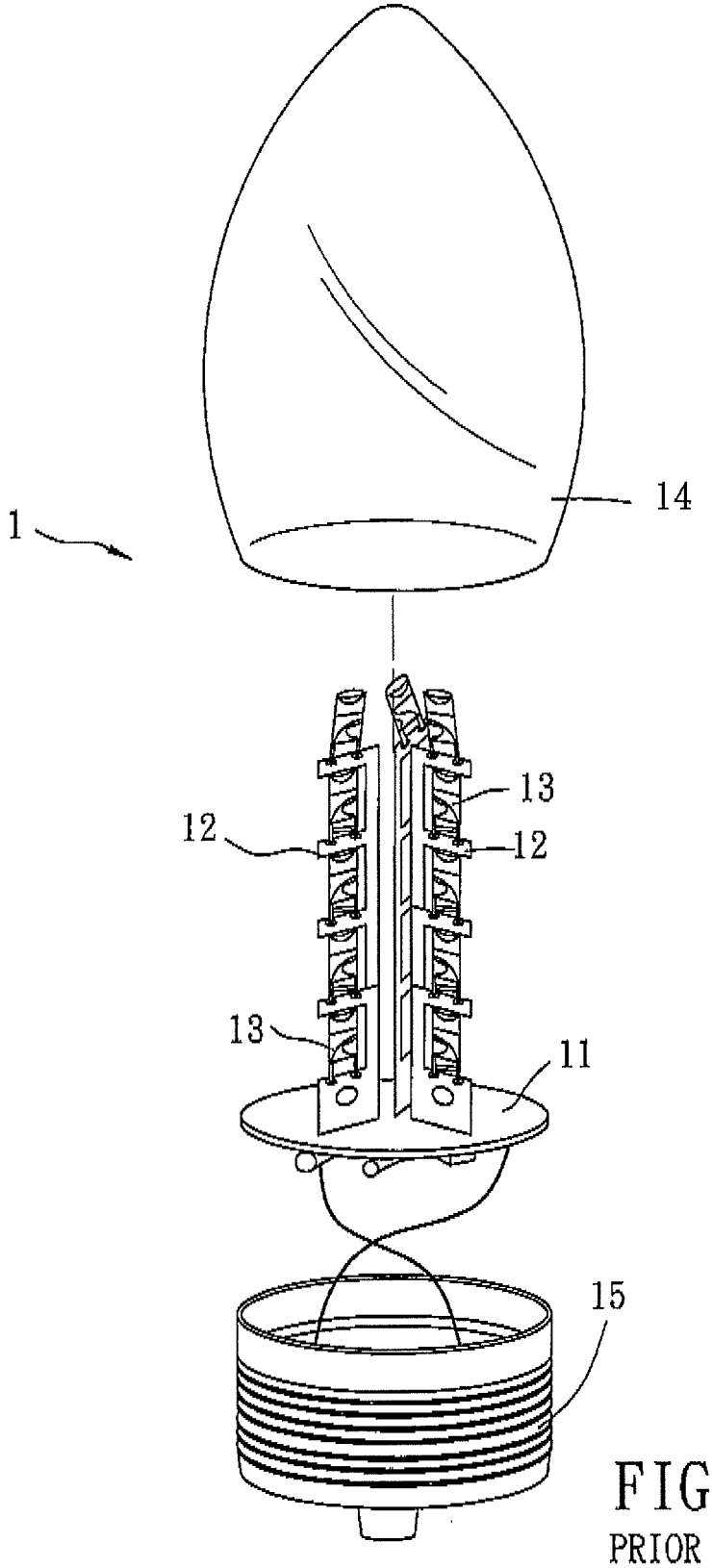
FIG. 1 PRIOR ART
FIG. 1 is a partly exploded perspective view of a conventional light bulb.
Figure 2:
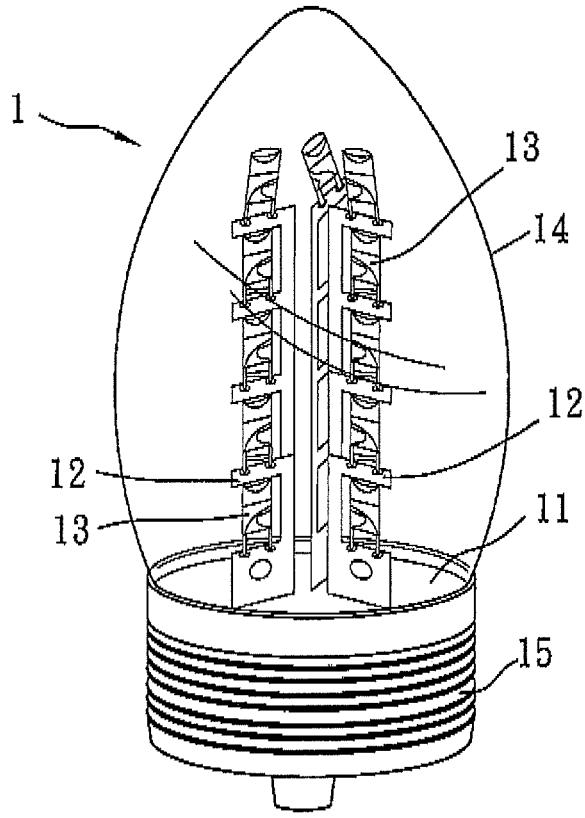
FIG. 2 PRIOR ART
FIG. 2 is a perspective view of the conventional light bulb.

Before the present invention is described in greater detail, it should be noted that like elements are denoted by the same reference numerals throughout the disclosure.

Figure 3:
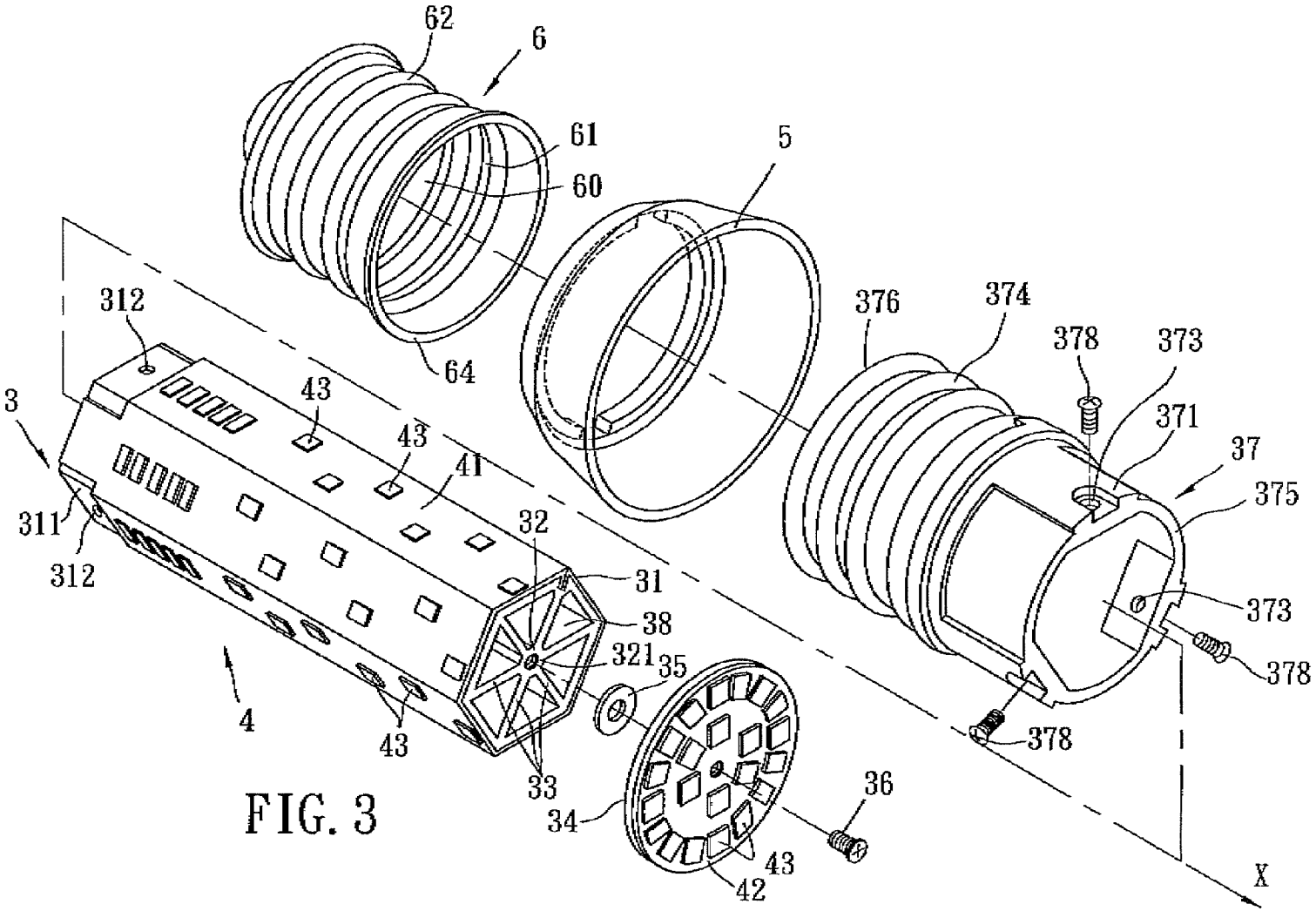
FIG. 3 is an exploded perspective view of a first preferred embodiment of a light bulb according to the present invention.
Figure 4:
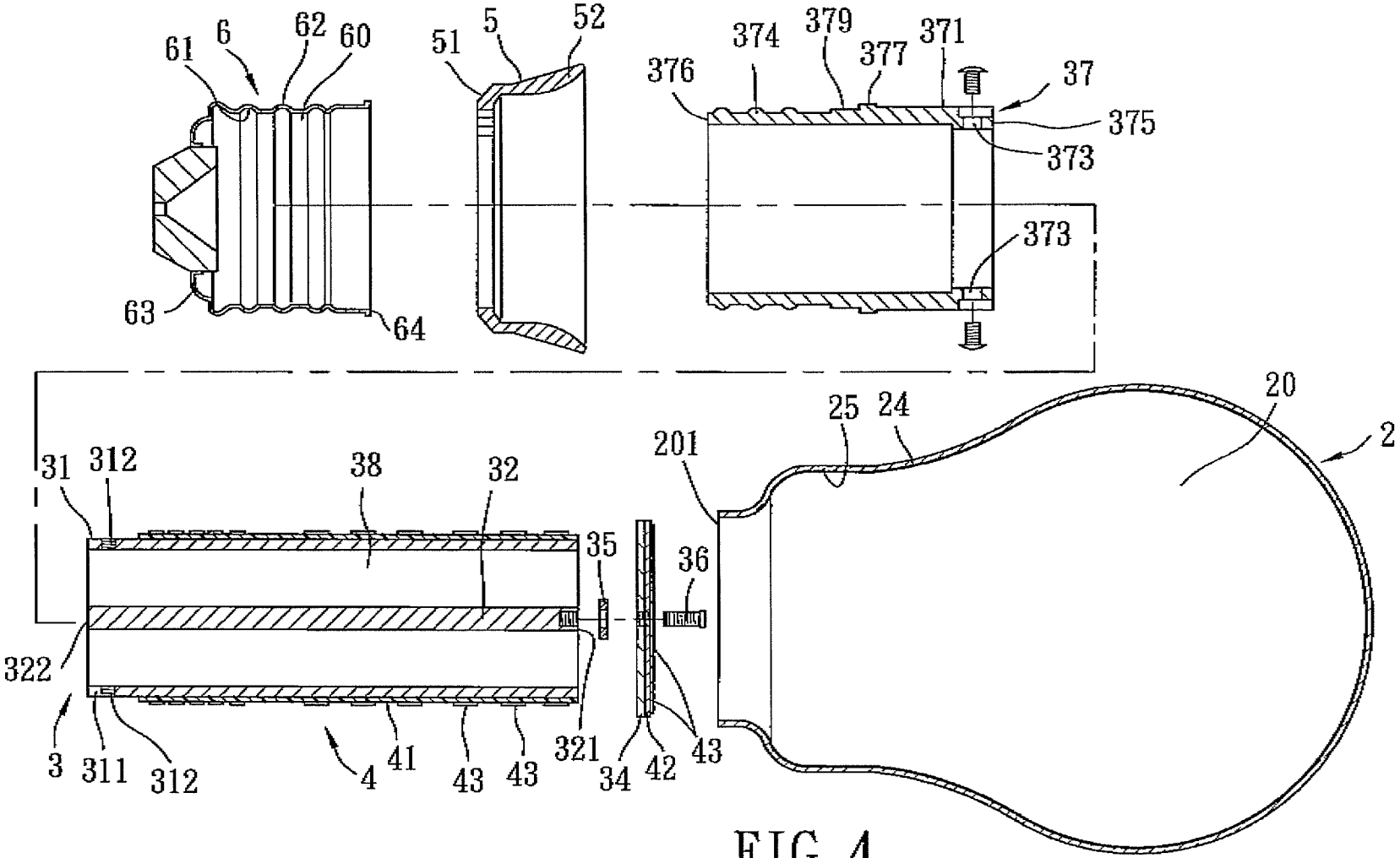
FIG. 4 is an exploded sectional view of the first preferred embodiment.
Figure 5:
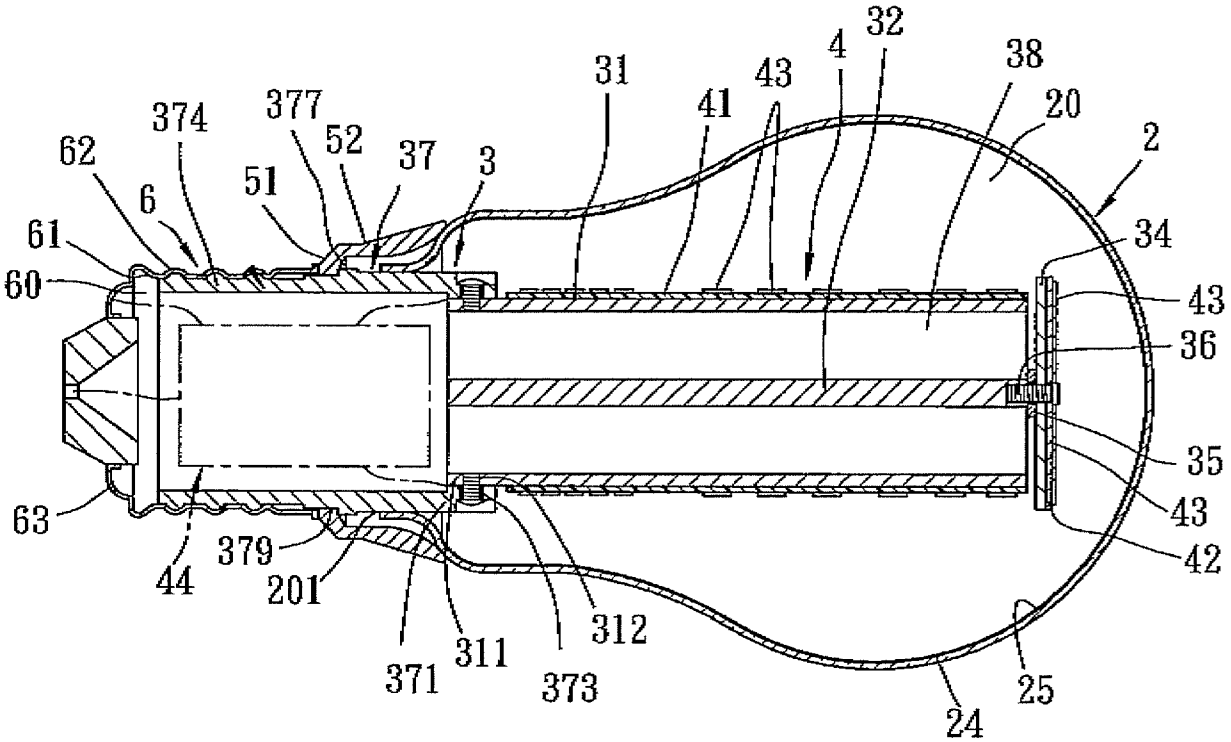
FIG. 5 is a sectional view of the first preferred embodiment.

FIGS. 3 to 5 show a first preferred embodiment of a light bulb according to the present invention. The light bulb comprises an enclosure 2, a heat-dissipating unit 3, a lamp unit 4, and a surrounding seat 5.

The enclosure 2 is made of glass and shaped as the bulb. The enclosure 2 extends along an axis (X), and has an open end 201 that is registered with the axis (X), an inner peripheral surface 24 that defines an inner space 20 therein, and a fluorescent coating 25 that is applied on the inner peripheral surface 24.

The heat-dissipating unit 3 includes a hollow first heat-dissipating element 31 that is disposed in the inner space 20 of the enclosure 2, a second heat-dissipating element 32 that is surrounded by the first heat-dissipating element 31, that extends along the axial direction (X), and that cooperates with the first heat-dissipating element 31 to define a heat-dissipating compartment 38 therebetween, and an end heat-dissipating element 34 that is mounted to the second heat-dissipating element 32 at a distal end 321 thereof that is distal from the open end 201 of the enclosure 2 along the axis (X).

In this embodiment, the heat-dissipating unit 3 further includes six angularly spaced-apart heat-dissipating connectors 33 that interconnect the second heat-dissipating element 32 and the first heat-dissipating element 31, a heat-conductive washer 35 that is disposed between the end heat-dissipating element 34 and the second heat-dissipating element 32, and a fastening member 36 that secures fixedly the end heat-dissipating element 34 and the heat-conductive washer 35 to the second heat-dissipating element 32. The heat-dissipating unit 3 further includes a third heat-dissipating element 37 that has inner end 375 connected to the first heat-dissipating element 31, and an outer end 376 extending outwardly of the open end 201 of the enclosure 2, thereby permitting heat conduction from the first heat-dissipating element 31 to the third heat-dissipating element 37. It should be noted that the first and third heat-dissipating elements 31, 37 may be formed integrally in other embodiments of this invention.

In this embodiment, the first and second heat-dissipating elements 31, 32, and the heat-dissipating connectors 33 are made of heat-conductive material, such as aluminum, and are formed integrally. The end heat-dissipating element 34, the heat-conductive washer 35, and the third heat-dissipating element 37 are also made of aluminum. The fastening member 36 is configured as a screw and is also made of a heat-conductive material. Therefore, heat conduction between the above-mentioned elements is permitted.

The first heat-dissipating element 31 is formed as a hollow hexagonal prism, and has a mounting portion 311 that is adjacent to the open end 201 of the enclosure 2, and that is formed with a plurality of mounting holes 312. The third heat-dissipating element 37 has a mounting portion 371 at the inner end 375. The mounting portion 371 has a shape corresponding to and is sleeved fittingly on the mounting portion 311 of the first heat-dissipating element 31. The mounting portion 371 of the third heat-dissipating element 37 is formed with a plurality of mounting holes 373 that are aligned respectively with the mounting holes 312 of the first heat-dissipating element 31. The third heat-dissipating element 37 and the first heat-dissipating element 31 are connected fixedly to each other by a plurality of screws 378 extending though the mounting holes 312, 373. It should be noted that the first heat-dissipating element 31 may be shaped as a polygonal prism or a cylinder in other embodiments of this invention.

The lamp unit 4 is mounted to the heat-dissipating unit 3 and includes a first circuit board 41 that is a flexible printed circuit board surrounding the first heat-dissipating element 31, a second circuit board 42 that is mounted on the end heat-dissipating element 34 at one side opposite to the open end 201 along the axis (X), and a plurality of light-emitting elements 43 that are mounted on the first and second circuit boards 41, 42 for emitting light beams converting circuit The light-emitting elements 43 of the lamp unit 4 are light-emitting diodes (LEDs) that are economical in terms of power consumption thereby rendering the light bulb of this invention an energy-saving light bulb. The light-emitting elements 43 also provide a high illumination intensity, and that are arranged on the first and second circuit boards 41, 42 so as to provide a 360° illumination. Further, composition of the fluorescent coating 25 applied on the inner peripheral surface 24 is selected to be excited by the ultraviolet radiation of the light-emitting elements 43, and converts light beams emitted by the light-emitting elements 43 to output uniform illumination. For example, when the LEDs emit blue light, the selected composition of the fluorescent coating 25 may convert the blue light into natural light.

The light bulb of this invention further comprises a hollow contact unit 6 including a contact body that has an internally threaded surface 61 defining a receiving space 60 therein, and an externally threaded surface 62 opposite to the internally threaded surface 61, and that is formed with an opening 64 forward the open end 201 of the enclosure 2 and a plurality of heat-dissipating holes 63 (only one is visible) formed at a rear end of the hollow contact unit 6 that is distal from the open end 201 of the enclosure 2. The third heat-dissipating element 37 further has an externally threaded portion 374 at the inner end 376 thereof and extending into the receiving space 60 through the opening 64 to engage the internally threaded surface 61 of the contact unit 6 so as to permit heat conduction therebetween. The hollow contact unit 6 is able to engage threadedly a commercially available lamp socket (not shown) so as to provide electric power for the light-emitting elements 43. The third heat-dissipating element 37 may be in other kinds of contact engagement with the contact unit 6 in other embodiments of this invention.

The AC/DC converting circuit 44 is mounted in the third heat-dissipating element 37 and includes a circuit board (not shown) and conductive wires (not shown) connected to the hollow contact unit 6 and the first and second circuit boards 41, 42. Since the feature of this invention does not reside in the AC/DC converting circuit 44, further details of the same are omitted herein for the sake of brevity.

The surrounding seat 5 has a connecting part 51 sleeved on the third heat-dissipating element 37 and a surrounding part 52 extending outwardldy and obliquely from the connecting part 51 and having an inner diameter that increases toward the open end 201 of the enclosure 2. The enclosure 2 has an open section 21 defining the open end 201 and extending between the connecting part of the surrounding seat 5 and the third heat-dissipating element 37. The third heat-dissipating element 37 is formed with an annular protrusion 377 that cooperates with a front and of the contact body of the contact unit 6 adjacent to the opening 64 to define a clamping groove 379 therebetween. The connecting portion 51 of the surrounding seat 5 is retained in the clamping groove 379 so as to be positioned relative to the third heat-dissipating element 37. As such, the third heat-dissipating element 37 can also serve as a positioning seat so as to position the first heat-dissipating element 31 relative to the enclosure 2.

Heat generated by the light-emitting elements 43 during use of the light bulb of this invention is conducted to the first and end heat-dissipating elements 31, 34 through the first and second circuit boards 41, 42, and is further conducted to the second heat-dissipating elements 32 through the heat-conductive washer 35 and the heat-dissipating connectors 33. Moreover, heat can also be conducted from the first heat-dissipating element 31 to the third heat-dissipating element 37 so as to be dissipated outwardly of the enclosure 2. Heat generated by the lamp socket can also be conducted to the third heat-dissipating element 37 through the contact unit 6. Therefore, heat can be dissipated efficiently.

Additionally, a heat-conductive insulator (not shown) may be disposed between the third heat-dissipating element 37 and the hollow contact unit 6, such that the third heat-dissipating element 37 is electrically-insulated from the hollow contact unit 6. Similarly, heat-conductive insulators may also be disposed between the first heat-dissipating element 31 and the first circuit board 41, and between the end heat-dissipating element 34 and the second circuit board 42.

Figure 6:
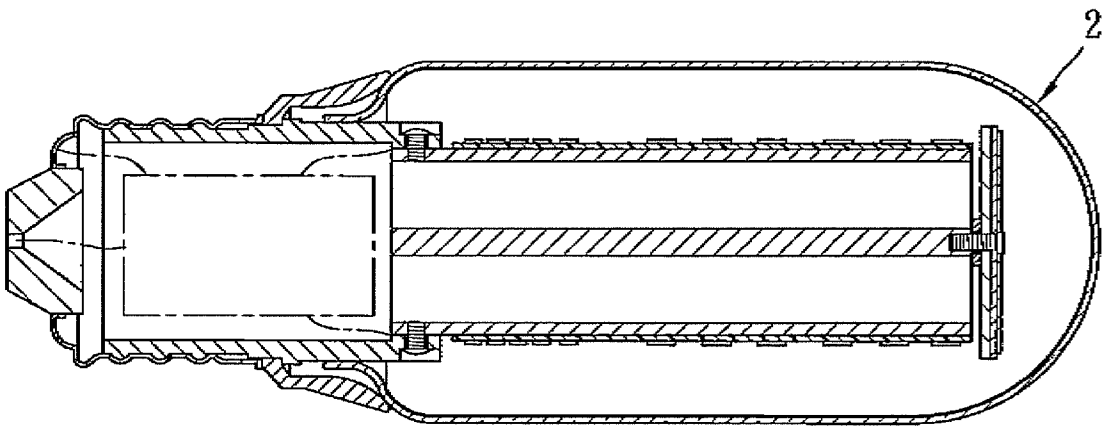
FIG. 6 is a sectional view of a second preferred embodiment of the light bulb according to the present invention.

Referring to FIG. 6, a second preferred embodiment of the light bulb according to the present invention has a structure similar to that of the first embodiment. The main difference between this embodiment and the first embodiment resides in that the enclosure 2 is configured as a tube that has a uniform diameter.

Figure 7:
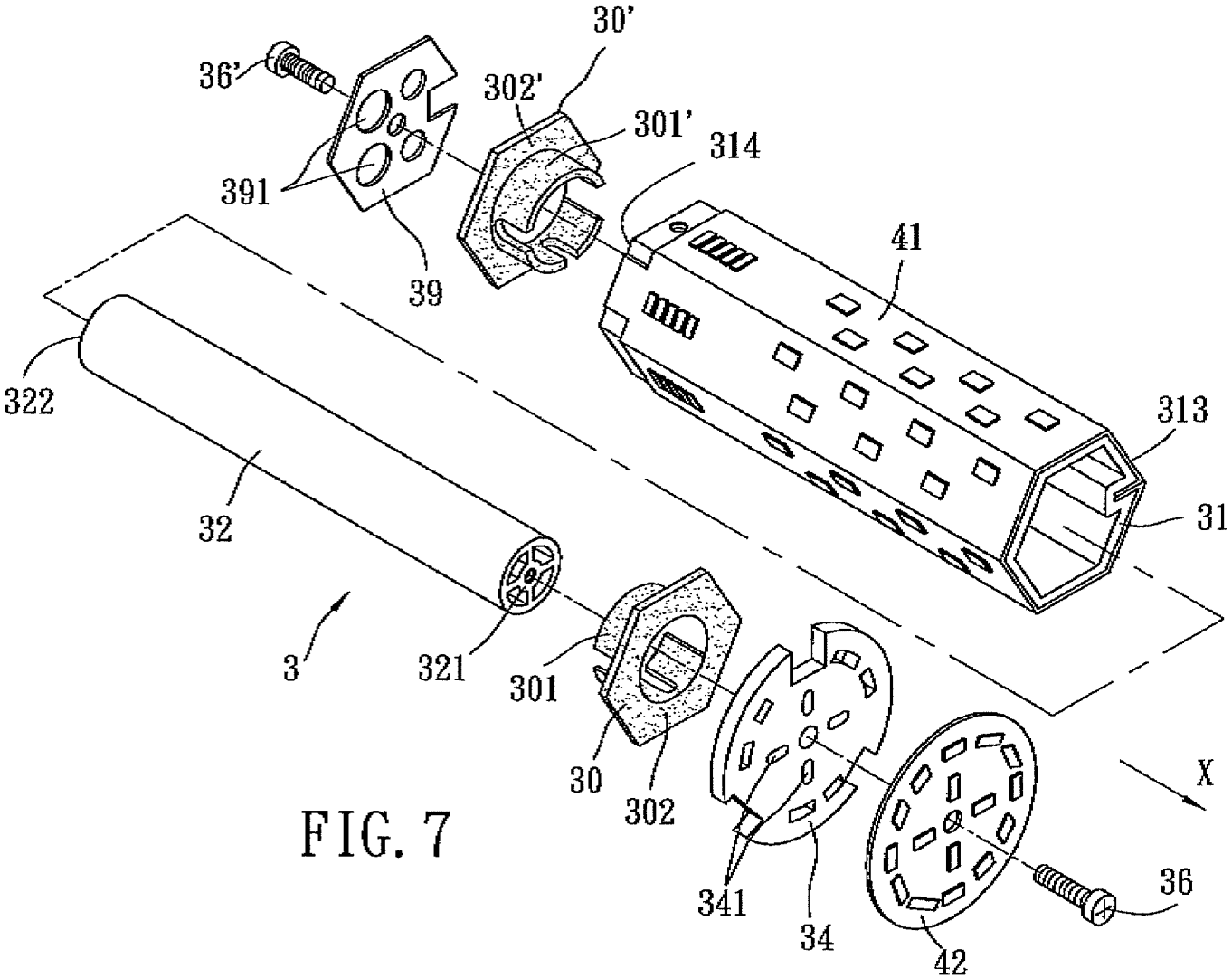
FIG. 7 is an exploded perspective view of a third preferred embodiment of the light bulb according to the present invention.
Figure 8:
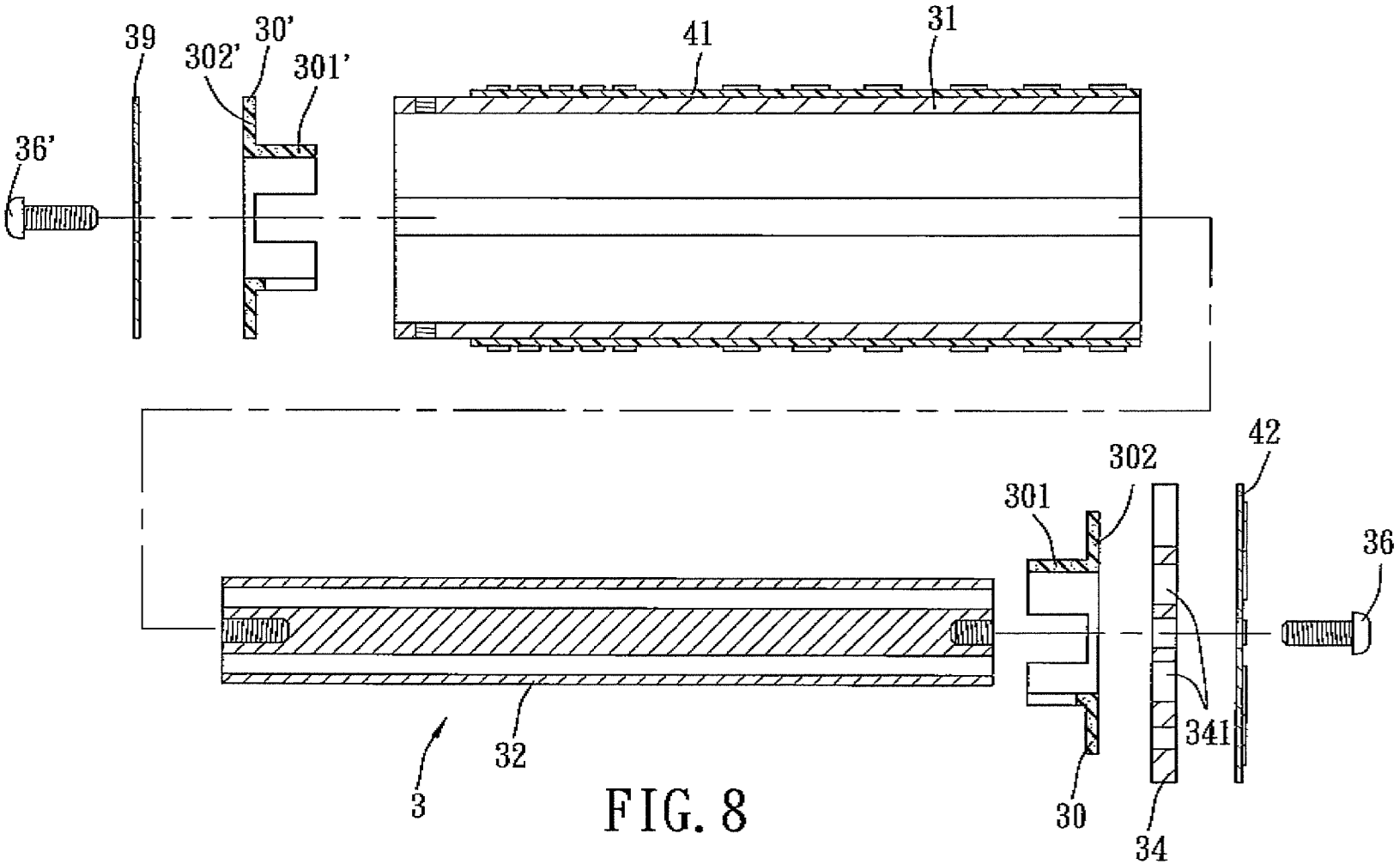
FIG. 8 is an exploded sectional view of the third preferred embodiment.
Figure 9:
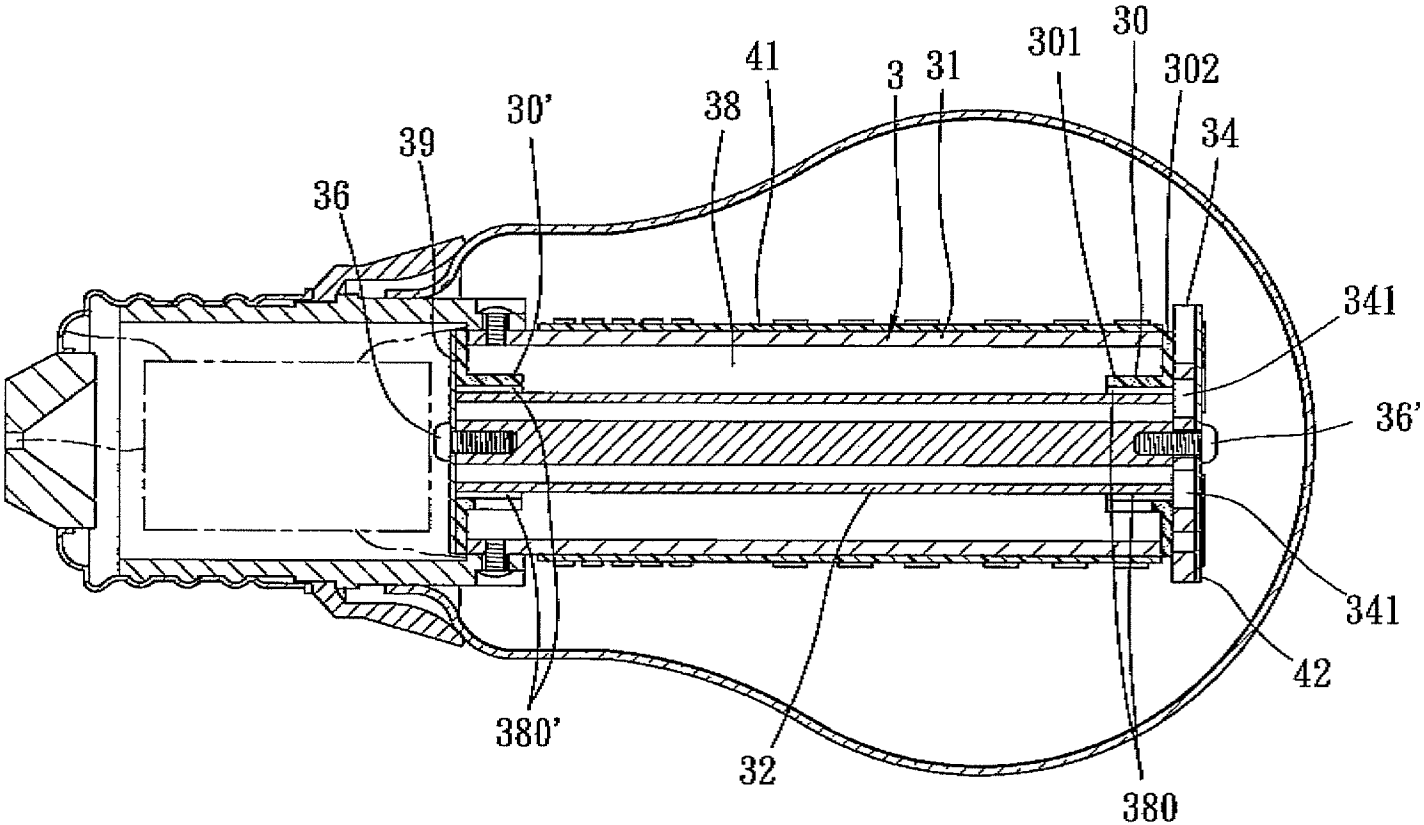
FIG. 9 is a sectional view of the third preferred embodiment.

Referring to FIGS. 7 to 9, a third preferred embodiment of the light bulb according to the present invention has a structure similar to that of the first embodiment. The main difference between this embodiment and the first embodiment resides in the following. In this embodiment, the heat-conductive connectors 33 as illustrated in the first preferred embodiment are omitted, and the first and second heat-conductive elements 31, 32 are spaced apart from each other in a radial direction that is transverse to the axis (X). The heat-dissipating unit 3 further includes first and second heat-insulating members 30, 30', a washer 39, and first and second fastening members 36, 36'.

The first heat-insulating member 30 has a contact segment 302 that is coupled directly to a proximate end 314 of the first heat-dissipating element 31 corresponding to a proximate end 322 of the second heat-dissipating element 32 that is opposite to the distal end 321 thereof along the axis (X) and that is proximate to the open end 201 of the enclosure 2, and a separating segment 301 that from the contact segment 302 extends in the axial direction (X) between the first and second heat-dissipating elements 31, 32. The second heat-insulating member 30' is disposed between the end heat-dissipating element 39 and a combination of the first and second heat-dissipating elements 31, 32. The second heat-insulating member 30' has a contact segment 302' that is coupled directly to a distal end 313 of the first heat-dissipating element 31 corresponding to the distal end 321 of the second heat-dissipating element 32, and a separating segment 301' that extends from the contact segment 302' in the axial direction (X) between the first and second heat-dissipating elements 31, 32. The separating segments 301, 301' are spaced apart from the second heat-dissipating element 32 in the radial direction, such that a gaps 380 is formed between the first heat-insulating member 30 and the second heat-dissipating element 32, and that a gap 380' is formed between the second heat-insulating member 30' and the second heat-dissipating element 32. The gaps 380, 380' are in fluid communication with the heat-dissipating compartment 38 (see FIG. 9).

The washer 39 is mounted to the proximate end 322 of the second heat-dissipating element 32 and the first heat-insulating member 30. Therefore, the end heat-dissipating element 34, the washer 39, and the second heat-dissipating element 32 are heat-insulated from the first heat-dissipating element 31. The heat-insulating members 30, 30' may be made of silica gel or other heat-insulated material.

The end heat-dissipating element 34 and the washer 39 are formed respectively with a plurality of spaced apart heat-dissipating holes 341, 391 that are in fluid communication with the heat-dissipating compartment 38. The second circuit board 42 is also formed with a plurality of heat-dissipating holes (not shown) in fluid communication with the heat-dissipating holes 391. The first fastening member 36 secures the washer 39 to the proximate end 322 of the second heat-dissipating element 32. The second fastening member 36' secures the second circuit board 42 and the end heat-dissipating element 34 to the distal end 321 of the second heat-dissipating element 32.

By virtue of the heat-insulating members 30, 30' heat conduction from the first circuit board 41 to the first heat-dissipating element 31, and from the second circuit board 42 to the second heat-dissipating element 32 through the end heat-dissipating element 34 will result in a temperature difference between the first and second heat-dissipating elements 31, 32, thereby conducting a heat convection in the heat-dissipating compartment 38. Further, heated air in the heat-dissipating compartment 38 exchanges heat with air outside the heat-dissipating compartment 38 through the gaps 380, 380' so as to facilitate heat-dissipating effect of the heat-dissipating unit 3.

To sum up, the advantages of the present invention are as follows. The light-emitting elements 43 of the lamp unit 4 are arranged on the first and second circuit boards 41, 42 to provide a 360° illumination. Moreover, heat generated by the light-emitting elements 43 and other components of the light bulb during use can be conducted to the first and second heat-dissipating elements 31, 32, and then be dissipated outwardly of the enclosure 2 either through the third heat-dissipating element 37 or through the gaps 380, 380' (as illustrated in the third embodiment). Therefore, the heat-dissipating ability of the light bulb is increased, such that the service life of the light bulb of this invention is lengthened.

While the present invention has been described in connection with what are considered the most practical and preferred embodiments, it is understood that this invention is not limited to the disclosed embodiments but is intended to cover various arrangements included within the spirit and scope of the broadest interpretation so as to encompass all such modifications and equivalent arrangements.

What is claimed is:

1. A light bulb comprising:

an enclosure extending along axis, defining an inner space therein, and having an open end that is registered with the axis;

a heat-dissipating unit including a hollow first heat-dissipating element that is disposed in said inner space of said enclosure, a second heat-dissipating element that is surrounded by said first heat-dissipating element, that extends along the axial direction, and that cooperates with said first heat-dissipating element to define a heat-dissipating compartment therebetween, wherein said first and second heat-dissipating elements are spaced apart from each other in a radial direction that is transverse to the axis, and an end heat-dissipating element that is mounted to said second heat-dissipating element at a distal end thereof that is distal from said open end of said enclosure;

a lamp unit including a first circuit board that is disposed at a periphery of said first heat-dissipating element, a second circuit board that is mounted on said end heat-dissipating element at one side opposite to said open end along the axis, and a plurality of light-emitting elements that are mounted on said first and second circuit boards for emitting light beams;

a first heat-insulating member having a contact segment that is coupled to a proximate end of said first heat-dissipating element corresponding to a proximate end of said second heat-dissipating element that is opposite to said distal end thereof along the axis and that is proximate to said open end of said enclosure, and a separating segment that extends from said contact segment of said first heat-insulating member in the axial direction between said first and second heat-dissipating elements;

a second heat-insulating member disposed between said end heat-dissipating element and a combination of said first and second heat-dissipating elements, said second heat-insulating member having a contact segment that is coupled to a distal end of said first heat-dissipating element corresponding to said distal end of said second heat-dissipating element, and a separating segment that extends from said contact segment of said second heat-insulating member in the axial direction between said first and second heat-dissipating elements;

a washer mounted to said proximate end of said second heat-dissipating element and said first heat-insulating member, said end heat-dissipating element and said washer being formed with a plurality of spaced apart heat-dissipating holes that are in fluid communication with said heat-dissipating compartment;

a first fastening member securing said washer to said proximate end of said second heat-dissipating element; and a second fastening member securing said second circuit board and said end heat-dissipating element to said distal end of said second heat-dissipating element.

2. The light bulb as claimed in claim 1, wherein said heat-dissipating unit further includes a fastening member that secures fixedly said end heat-dissipating element to said second heat-dissipating element.

3. The light bulb as claimed in claim 1, wherein said heat-dissipating unit further includes a third heat-dissipating element that has an inner end connected to said first heat-dissipating element, and an outer end extending outwardly of said open end of said enclosure, thereby permitting heat conduction from said first heat-dissipating element to said third heat-dissipating element.

4. The light bulb as claimed in claim 3, further comprising a hollow contact unit that has an inner surface defining an receiving space, said outer end of said third heat-dissipating element extending into said receiving space and being in contact with said inner surface.

5. The light bulb as claimed in claim 3, wherein said first heat-dissipating element has a mounting portion adjacent to said open end of said enclosure, said third heat-dissipating element having a mounting portion that is sleeved fittingly on said mounting portion of said first heat-dissipating element.

6. The light bulb as claimed in claim 1, wherein said first heat-dissipating element is a hollow polygonal prism, said first circuit board being a flexible printed circuit board surrounding said first heat-dissipating element, said light-emitting elements of said lamp unit being light-emitting diodes.

7. A light bulb comprising:

an enclosure extending along an axis, defining an inner space therein, and having an open end that is registered with the axis;

a heat-dissipating unit including a hollow first heat-dissipating element that is disposed in said inner space of said enclosure, a second heat-dissipating element that is surrounded by said first heat-dissipating element, that extends along the axial direction, and that cooperates with said first heat-dissipating element to define a heat-dissipating compartment therebetween, and an end heat-dissipating element that is mounted to said second heat-dissipating element at a distal end thereof that is distal from said open end of said enclosure; and a lamp unit including a first circuit board that is disposed at a periphery of said first heat-dissipating element, a second circuit board that is mounted on said end heat-dissipating element at one side opposite to said open end along the axis, and a plurality of light-emitting elements that are mounted on said first and second circuit boards for emitting light beams;

wherein said enclosure further has an inner peripheral surface defining said inner space, and a fluorescent coating applied on said inner peripheral surface.

* * * * *